US009275818B1

(12) United States Patent
Zeh

(10) Patent No.: US 9,275,818 B1
(45) Date of Patent: Mar. 1, 2016

(54) METHOD OF MAKING AND USE OF AN AUTOMATIC SYSTEM TO INCREASE THE OPERATING LIFE OF VACUUM TUBES WITH A VACUUM TUBE DEVICE

(71) Applicant: Mark A. Zeh, Minuch (DE)

(72) Inventor: Mark A. Zeh, Minuch (DE)

( * ) Notice: Subject to any disclaimer, the term of this patent is extended or adjusted under 35 U.S.C. 154(b) by 0 days.

(21) Appl. No.: 14/282,733

(22) Filed: May 20, 2014

Related U.S. Application Data

(60) Provisional application No. 61/855,632, filed on May 20, 2013.

(51) Int. Cl.
*H05B 39/00* (2006.01)
*H01J 19/02* (2006.01)
*H01J 1/13* (2006.01)

(52) U.S. Cl.
CPC *H01J 19/02* (2013.01); *H01J 1/135* (2013.01)

(58) Field of Classification Search
CPC ..... H05B 33/0815; H05B 33/0818; H05B 37/02; H05B 41/3925; H05B 41/2828; H05B 33/0803
USPC ..... 315/91, 94; 313/310; 330/113
See application file for complete search history.

(56) References Cited

U.S. PATENT DOCUMENTS

| | | | | |
|---|---|---|---|---|
| 3,931,550 | A | 1/1976 | Dalpee | |
| 3,942,041 | A | 3/1976 | Morriss | |
| 4,675,573 | A | 6/1987 | Miram et al. | |
| 5,430,600 | A | 7/1995 | Burns | |
| 7,572,028 | B2 * | 8/2009 | Mueller et al. | 362/227 |
| 2004/0132167 | A1 * | 7/2004 | Rule et al. | 435/287.1 |
| 2008/0068832 | A1 * | 3/2008 | Spartano et al. | 362/157 |
| 2009/0008995 | A1 * | 1/2009 | Cyr | 307/31 |
| 2009/0061987 | A1 * | 3/2009 | Canterbury et al. | 463/20 |
| 2010/0134016 | A1 * | 6/2010 | York et al. | 315/113 |
| 2013/0258574 | A1 * | 10/2013 | Pamley et al. | 361/679.31 |

* cited by examiner

*Primary Examiner* — Douglas W Owens
*Assistant Examiner* — Syed M Kaiser
(74) *Attorney, Agent, or Firm* — Loginov & Associates, PLLC; William A. Loginov

(57) ABSTRACT

A vacuum tube optimization circuit can automatically ensuring that the preheating required for the thermionic effect to occur within the vacuum tubes within a vacuum tube device, has been sufficient to allow the vacuum tubes to reach their operating temperatures, before allowing signal voltage or current to be applied to their anodes, cathodes, and/or other thermionically-active components. This reduces the diffusion of component-specific surface material coatings onto the surfaces of other internal elements within the vacuum tube, functioning to extend the service life of the vacuum tubes.

16 Claims, 4 Drawing Sheets

METHOD OF MAKING AND USE OF AN AUTOMATIC SYSTEM TO INCREASE THE OPERATING LIFE OF VACUUM TUBES WITH A VACUUM TUBE DEVICE

RELATED APPLICATIONS

This application claims the benefit of U.S. Provisional Application Ser. No. 61/855,632, filed May 20, 2013, entitled METHOD OF MAKING AND USE OF AN AUTOMATIC SYSTEM TO INCREASE THE OPERATING LIFE OF VACUUM TUBES WITH A VACUUM TUBE DEVICE, the entire disclosure of which is herein incorporated by reference.

FIELD OF THE INVENTION

The present invention relates to electronic circuitry for increasing the operating life of vacuum tubes within a vacuum tube device.

BACKGROUND OF THE INVENTION

Vacuum tubes remain the preferred method of signal amplification in a variety of devices, including high-end audio and instrument amplification, as well as radio broadcast. Vacuum tubes function using the principal of thermionic emission. This phenomenon is based on the fact that when a positive voltage potential exists between the anode and cathode of the vacuum tube, and they are heated, electrons are emitted by the cathode and cross the vacuum space to the anode.

This means that within vacuum tubes, heat may be supplied to the cathode through a variety of means, direct of indirect. Direct heating of the cathode usually involves superimposing a "heater" voltage onto whatever signal voltages also occur at the cathode, in order to heat it through electrical resistance. This often has the result of including undesirable noise and other types of signal disruptions into the functions being performed by the vacuum tube.

Vacuum tubes (or electron tubes, or thermionic valves), of the indirectly heated cathode type, contain a few distinct component types: First is a circuit wherein a small AC or DC voltage is applied to a cathode heater circuit. The only function of this circuit is to heat the cathode to an operating temperature, where it will emit electrons at the rates described in the design specification for the Tube. The other internal components generally consist of the cathode, anode and control grids and plates. These components generally operate at much-higher power levels (high voltage and/or current). These components become operable, to various degrees, as the electron emitting components inside of the vacuum tube rise in temperature, on their way to reaching the design temperature of the vacuum tube.

Most commonly, indirect cathode heating is effected using components called filaments. These are generally resistive wires, made of a variety of metals, generally functioning at a separate, lower voltage, and through a separate power supply system, from that of the cathode/anode/grid bias/diode plate/other internal component systems. These use the heat transfer mode of radiation to heat the cathode to its design operating temperature and maintain it at that temperature, during device operation.

It must be noted that vacuum tubes are non-ideal devices, so as they are heated, electrons are also emitted from all of their electron-emissive, internal components, including heater filaments, diode plates, and grids. When a vacuum tube reaches its design operating temperature, the very-large potential between the cathode and anode becomes the dominant path for electron flow.

In most vacuum tube devices, the circuit providing control grid bias (if used) and the high voltage potential to the vacuum tube anodes and other internal components, is switched on at the same time as that of the lower voltage power to the filaments. The result is that as the vacuum tube gradually warms up, electrons begin to flow between the electronically-emissive internal components of the vacuum tube components and its anode, before the vacuum tube reaches its design operating temperature.

During these initial states of current flow, before the tube is at its designed operating temperature, currents can flow for brief periods of time between the various internal components. These current conditions, which are outside the designed operating conditions of the vacuum tube, are damaging to the internal components of the vacuum tube and/or their emissive coatings, contributing to "wear" in the tube, which can be a cause of its ultimate need for replacement.

Although it is not present on all devices containing vacuum tubes, many vacuum tube device manufacturers include a "standby" switch, which independently switches the circuits supplying power to various non-heater internal functions of the vacuum tube on and off.

This means that when device power is switched on and the standby switch is switched to "standby," power only flows to the cathode heater circuits, warming the vacuum tubes. In the condition where the device is already in operation and the user switches the device to "standby," power to the anodes, cathodes, and/or other thermionically-active components of the vacuum tubes, which are non-cathode heater internal components of the vacuum tube, is switched off, while power to the vacuum tube heaters is maintained.

In order to avoid the condition where power is applied to the anodes, cathodes, and/or other thermionically-active components of the vacuum tubes, which are non-cathode heater internal components of the vacuum tube, before the vacuum tube has reached its design temperature, many manufacturers advise their customers to always have the device switched to "standby," at the moment when they switch their devices on, in order to allow the vacuum tubes to warm up. However, the user must then decide when the standby switch can reasonably be switched off and wait the appropriate amount of time to manually do this. Presently, there is no feedback given to the user, as to when they can switch their devices into operational mode. Additionally, the amount of time required for warmup varies by vacuum tube type, is generally only subjectively given to the end-user, and further, is prone to interpretation by the end user.

The purpose of the standby switch is to switch off signal inputs, while either allowing the vacuum tubes to reach their operating temperatures in the absence of signal voltages, or to maintain the vacuum tubes in the device at their operating temperatures. This eliminates the warmup time needed to use a vacuum tube device, when a pause is taken in its use. An example of this is when musicians who use vacuum tube instrument amplifiers, switch these devices to "standby" during pauses or intermissions in a live performance. This prevents unwanted noise and power consumption during the pauses, but allows the performers to immediately switch back on and use their devices, when they return to the stage.

Many types of vacuum tubes are no longer in production, hence are irreplaceable. Many other types of vacuum tubes, which are still in production, are of lower-quality, or have different operational characteristics, tone reproduction qualities, or other operating outputs, than previously-produced versions of them. Hence there is a strong need to extend the service life of vacuum tubes.

SUMMARY OF THE INVENTION

The present invention overcomes the disadvantages of the prior art by providing a system to help increase the longevity and durability of vacuum tubes by mitigating the wear which occurs during power-on and warmup cycles, before they begin to function in their intended uses.

This device is designed to function automatically, not requiring the user to do more than switch the device power on and off, or activate the standby switch, for example, in the event that a pause is taken during a performance where vacuum tube amplification is being used.

The invention is a subsystem integrated into a functioning electronic device using vacuum tubes.

The power supply of the vacuum tube device, providing power to the non-cathode heater components of the vacuum tubes, is the only system within the vacuum tube device, which is controlled by this invention.

This invention is actuated and de-actuated by the power switch, which actuates the complete vacuum tube device. If present, the standby switch on the device, which controls the power to the anodes, cathodes, and/or other thermionically-active components of the vacuum tubes, which are non-cathode heater internal components of the vacuum tube, also controls functions within this invention.

One aspect of the disclosure provides an electronic device, working as a subsystem of a device containing vacuum tubes, which automatically allows the vacuum tubes within a device to warm up to their operating temperatures, before non-signal voltage and current can be applied to their anodes, cathodes, and/or other thermionically-active components of the vacuum tubes, which are non-cathode heater internal components of the vacuum tube.

In one aspect of the disclosure, the electronic device includes a subsystem, controlled by an automatic control circuit, that switches voltage to the anodes, cathodes, and/or other thermionically-active components of the vacuum tubes, which are non-cathode heater internal components of the vacuum tube, on and off together.

In one aspect of the disclosure, the electronic device includes a subsystem, controlled by a manually-operated control circuit, which switches voltage to the anodes, cathodes, and/or other thermionically-active components of the vacuum tubes, which are non-cathode heater internal components of the vacuum tube, on and off together.

In one aspect of the disclosure, the electronic device includes a control circuit, activated by the device power switch, which determines when the device vacuum tubes have reached their operating temperatures.

In one aspect of the disclosure, the electronic device includes an electronic circuit, digital and/or analog, wherein the amount of time for warming the vacuum tubes to the point where they may operate within their design specifications may be set or adjusted to match, or exceed, the requirements of the vacuum tubes in the circuit.

In one aspect of the disclosure, the electronic device includes an electronic circuit, digital and/or analog, wherein the temperature of the vacuum tubes may be determined using one, or more, thermocouples or thermistors, either dedicated to temperature measurement, or having other main functions, but also being used for temperature measurement, applied to the tube surface, included into the tube socket, or applied to the tube socket surface.

In one aspect of the disclosure, the electronic device includes an electronic circuit, digital and/or analog, wherein the temperature of the vacuum tube heaters may be determined by measuring their internal resistance, using ohm's law.

In one aspect of the disclosure, the electronic device includes an electronic circuit, digital and/or analog, wherein the temperature of the vacuum tube cathode, and/or other representative components, from which cathode operating temperature may be imputed, may be determined using an optical measurement means, including emitted infrared light, color shift of a painted-on temperature-sensitive ink of pigment, or a temperature-dependent shift in refraction index through glass.

In one aspect of the disclosure, the electronic device includes a subsystem design wherein the automatic control circuit always overrides the manually-operated control circuit, ensuring that non-input-signal voltages and currents do not reach the anodes, cathodes, and/or other thermionically-active components of the vacuum tubes, which are non-cathode heater internal components of the vacuum tube, if said vacuum tubes have not reached their operating temperatures.

In one aspect of the disclosure, the electronic device includes a subsystem design wherein a switching means, actuated by switching off, or loss of, the device power, connects the large capacitors in the device power supply to ground through an electrical resistance, removing charge from the device power supply capacitors.

In one aspect of the disclosure, the electronic device includes a subsystem design wherein a switching means, actuated by turning on device power, disconnects the large capacitors in the device power supply from the aforementioned electrical resistance, allowing them to be charged.

In one aspect of the disclosure, the electronic device includes a subsystem, in which a warmup light, and/or tone, and/or other visual or auditory stimulus are activated, while the system is warming up and during which period signal input, or other processing functions will not be active within the vacuum tube device.

In one aspect of the disclosure, the electronic device includes a subsystem, wherein the warmup light and/or tone and/or other visual or auditory stimulus, will change in intensity or tone, as the progress towards an operating condition is reached. Among a wide plurality of embodiments, this could consist of a rising tone, lighted bar graph, a light with brightening intensity, a visual element, wherein distance to a goal is shown, etc.

In one aspect of the disclosure, the electronic device includes a subsystem, wherein a light, tone, or other indication of operational status of the device, would be switched on, at the point when the vacuum tubes have reached their design temperatures and voltage will be/is being switched on to their anodes, cathodes, and/or other thermionically-active components of the vacuum tubes, which are non-cathode heater internal components of the vacuum tube, which depend on non-cathode heating voltage for their functions.

BRIEF DESCRIPTION OF THE DRAWINGS

The invention description below refers to the accompanying drawings, of which.

DETAILED DESCRIPTION

The vacuum tube optimization circuit can automatically ensuring that the preheating required for the thermionic effect to occur within the vacuum tubes within a vacuum tube device, has been sufficient to allow the vacuum tubes to reach their operating temperatures, before allowing signal voltage or current to be applied to their anodes, cathodes, and/or other thermionically-active components. This reduces the diffusion of component-specific surface material coatings onto the surfaces of other internal elements within the vacuum tube, functioning to extend the service life of the vacuum tubes.

The vacuum tube optimization circuit can be a device working as a subsystem of devices using vacuum tubes (electron tubes or thermionic valves) of the indirectly-heated cathode type, which operate using the thermionic effect. These vacuum tube devices can include, for example, amplifiers, radio transmission or reception devices, television signal transmission or reception devices, RADAR systems, devices with precision switching (thyratrons and krytrons), microwave transmission (magnetrons), industrial Radio Frequency heating, Vacuum Flourescent Displays, etc. This vacuum tube optimization circuit can extend the service life of the valuable and often-irreplaceable vacuum tubes used to amplify signals and serve other functions within vacuum tube devices.

Additionally, the vacuum tube optimizer circuit functions to discharge the filter capacitors generally used in the power supplies of such devices, when power to the device is shut off. These capacitors generally contain high voltage, can deliver large amounts of instantaneous current, and hold their charge over long periods of time, even when the device is switched off. This extends a safety benefit to the user and repair person.

Figure 1A:
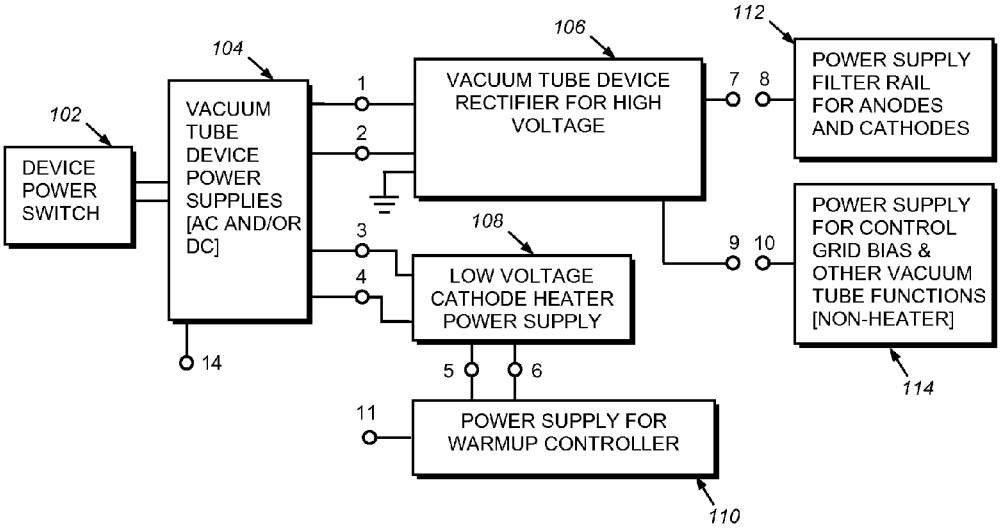
FIGS. 1A-C depict portions of a circuit diagram of one or more internal components of a vacuum tube device including a vacuum tube optimizer circuit according to one or more aspects of the disclosure.
Figure 1B:
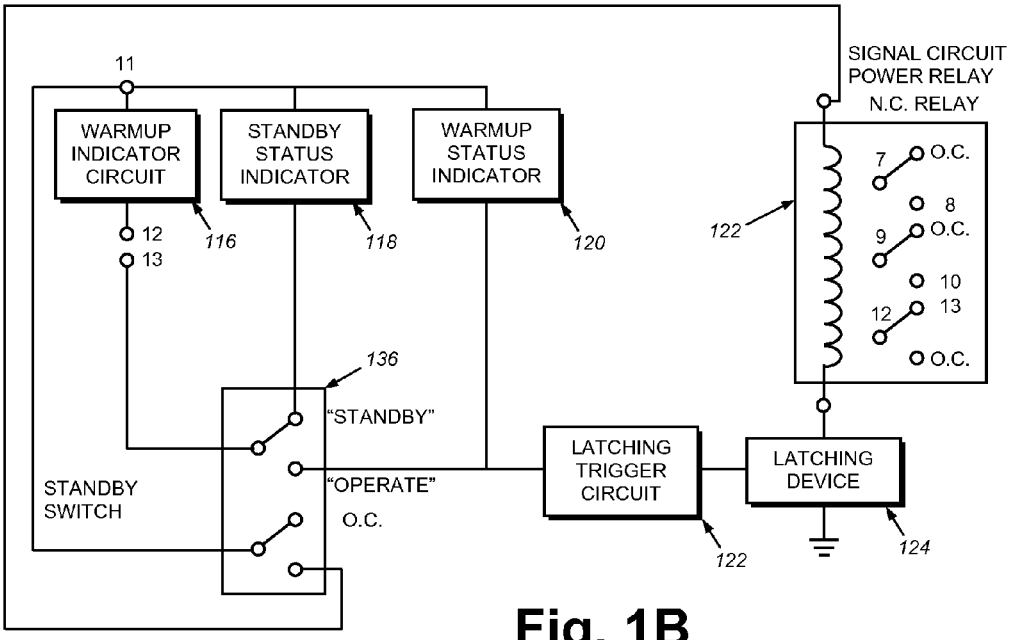
Figure 1C:
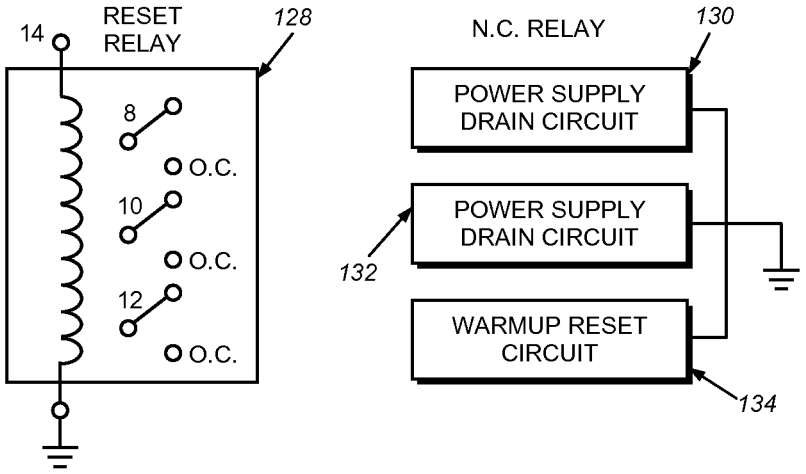

FIGS. 1A-C depict portions of a circuit diagram of one or more internal components of a vacuum tube device 100 including a vacuum tube optimizer circuit according to one or more aspects of the disclosure. As shown, the portions shown in FIGS. 1A, 1B, and 1C can be connected to one another by one or more pins 1-14, as depicted in each of the figures. The present vacuum tube optimizer circuit is either added-to, as an accessory, or designed-into a vacuum tube device.

The vacuum tube device 100 can include a user-operated device power switch 102. In another example, the power switch 102 can include a low voltage momentary switch, activating software on a digital device and/or firmware within a controller, or a latching relay, within the device. This multiplicity of potential means of switching the device to an active state can be represented as an "on/off" switch.

The vacuum tube device 100 can include a vacuum tube device power supply 104. The vacuum tube device power supply can include high voltage supplies associated with the anodes, cathodes, and/or other thermionically-active components of the vacuum tubes, which are non-cathode heater internal components of the vacuum tube is connected to pins 1 and 2.

The vacuum tube device 100 can include a vacuum tube device rectifier 106 for rectifying an alternating current (AC) power supply. Although a direct current (DC) supply, storage battery, switching power supply, or other direct current supply means could also be used, obviating the need for rectification, a rectifier for the Vacuum Tube Device is shown connected to pins 1 and 2, which create the DC potentials generally used to power the anodes, cathodes, and/or other thermionically-active components of the vacuum tubes, which are non-cathode heater internal components of the vacuum tube.

The vacuum tube device can include a low voltage heater power supply 108. The low voltage heater power supply 108 can be connected to the power supply 104 through pins 3 and 4 and can provide a low voltage AC supply for a cathode heater circuit. This power supply may be powered by either alternating- or direct current. The heating method can be conducted according to any type of heating method.

The vacuum tube device can include a power supply for warmup controller 110. Although it could also be powered by another separate power supply, the warmup controller 110 power supply is shown connected to the low voltage cathode heater power supply 108 via pins 5 and 6. This power supply could either receive direct current (DC) from the Low Voltage Cathode Heater Power Supply, or would have to be rectify this input to DC, if the Low Voltage Cathode Heater Power Supply were to supply it with alternating current. In one example, the power supply for warmup controller can supply power for standby status indicator, warmup status indicator, and signal circuit power relay, which will be described in greater detail below. In other examples, the indicators can be powered by other power sources.

The vacuum tube device can include a power supply filter rail for anodes and cathodes 112 and a power supply for control grid bias and other vacuum tube functions 114. The power supplies 112 and 114 can be connected to the rectifier 106 and can assist in converting AC power supplies in DC power to supply DC power to one or more components within the vacuum tube device, such as the vacuum tubes.

FIG. 1B depicts a circuit diagram of a portion of the vacuum tube optimizer circuit according to one or more aspects of the disclosure.

The vacuum tube optimizer circuit can include a warmup indication circuit 116. Warmup Indicator Circuit 116 can include a wide variety of analog or digital components, including, but not limited to, comparators, gates, programmable logic controllers, Programmable Integrated Circuits, systems of Logic gates, threshold detectors and/or logic gates.

In the case that Warmup Indicator Circuit 116 is a digital controller, software or firmware on the device will loop or wait until such time that the variable t, e.g., a time counted by the circuit 116, reaches a value wmup, e.g., a value of time for a vacuum tube to be heated to operational temperature.

The variable represented by "t" can be a variable representing time and can be physically embodied, determined, and/or stored in the warmup indicator circuit 116, such as by way of an RC circuit, wherein $t \approx R \cdot C$, with "R·C" being set equal to the longest warmup time, plus a small factor of safety, of any of the vacuum tubes in the device. When time is being used as a substitute for direct temperature measurement, time could also be measured by a wide variety of other digital and/or analog components, including combinations of inductors, capacitors and resistors. Additionally, this could be controlled though a plurality of means of digital timers, countup controllers, programmable logic controllers, etc.

The value of "wmup" may be held in memory, or as a function of the discharge rate of the RC timer circuit, or continuously assessed through checking the temperature measurement means available to the controller device. This value will be used in instances of switching power rapidly off/on or in instances where the device is only switched off for a time less than the cooldown time of the vacuum tubes.

Additionally, warmup circuit 116 could be replaced by, or placed in combination with, a variety of other readiness-detecting means, including a variety of temperature-sensing controller types. In one example, temperature sensing can be conducted by one or more thermocouples or thermistors applied to the vacuum tube surface, vacuum tube socket, vacuum tube socket surface, or any combination thereof. In another example, temperature can be determined by determined by measuring their internal resistance, using ohm's law. In yet another example, temperature can be determined by determined using an optical measurement means, including emitted infrared light, color shift of a painted-on temperature-sensitive ink of pigment, or a temperature-dependent shift in refraction index through glass.

In these examples, the variable t can have the units of a voltage, a temperature, or any other type of units. In this regard, the voltage can be a voltage output by a thermistor or other circuit element indicative of temperature. In yet another example, the variable t can be in the form of a temperature directly.

In the example where the vacuum tube device includes a standby switch, such as switch 136 shown in FIG. 1, the vacuum tube optimizer circuit can include a standby status indicator 118.

A Standby Status Indicator 118 is described in this invention. This could consist of a wide variety of types of feedback provided to the user, including, but not limited to, acoustic feedback, flashing lights, tactile feedback, an function-specific animation on a display on the device, etc.

The vacuum tube optimizer circuit can include a warmup status indicator 120. The warmup status indicator 120 can include a wide variety of types of feedback provided to the user, including, but not limited to, acoustic feedback, flashing lights, progressive addition to a lighted bar graph, tactile feedback, an function-specific animation on a display on the device, etc.

The vacuum tube optimizer circuit can include a latching trigger circuit 122. In the present embodiment of the invention, the Latching Circuit includes a number of passive components and a transistor.

The vacuum tube optimizer circuit can include a latching device 124. The latching device can be a Thyristor.

The vacuum tube optimizer circuit can include a signal circuit power relay 126. The signal circuit power relay 126 is a latching triple pole single throw, normally closed relay. The functions served by Signal Circuit Power Relay 126 could also be served by a wide variety of other types of devices, including, but not limited to: Triacs, Silicon Control Rectifiers, Mercury Switches, High Voltage Transistors, etc. The signal circuit power relay 126 can include one or more open circuits O.C., as shown in FIG. 1.

Signal Circuit Power Relay 126 and its associated latching function could also be created using a number of other means, including, but not limited to, latching relays, a variety of digital controller means, threshold devices, programmable logic controllers actuating another relay, etc.

A double throw, double pole standby switch 136 is included in this embodiment of the vacuum tube device. A variety of other typologies of switch could also be used.

FIG. 1C depicts a circuit diagram of a portion of the vacuum tube optimizer circuit according to one or more aspects of the disclosure.

The vacuum tube optimizer circuit can include a reset relay 128. As in the embodiment of the invention shown in FIG. 1, Reset Relay 128 is a triple pole, single throw, normally-closed relay, switching three separate circuits through a double-pole single-throw switch. In the first circuit, a Power Supply Drain Circuit 130 is connected between the device power supply capacitors and ground, draining the charge from the device power supply. The second circuit connected to Reset Relay C discharges the capacitors of the control grid bias power supply through Power Supply Drain Circuit 132. In the third circuit, Warmup Reset Circuit 134 is connected between the temperature sensing circuit and ground. The reset relay can include one or more open circuits O.C.

In the embodiment shown in drawing three, the warmup circuit indicator 116 can include an RC circuit set to a time constant matching the warmup time of the vacuum tube in the device having the longest warmup time. Therefore, draining the capacitor in the RC circuit has the function of resetting the Warmup Indicator Circuit 116 to zero.

Figure 2:
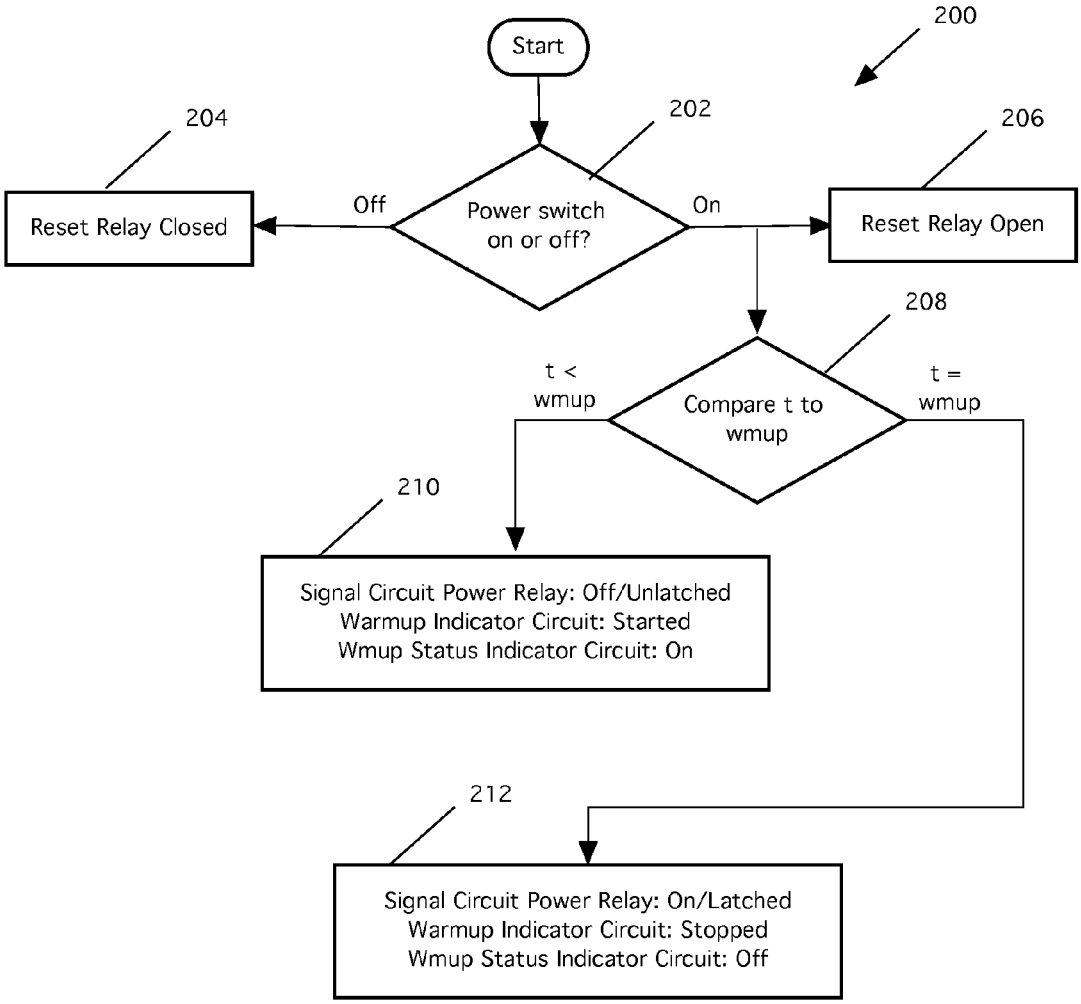
FIG. 2 is a flow chart depicting operation of the vacuum tube optimizer circuit with a vacuum tube device without a standby switch.
Figure 3:
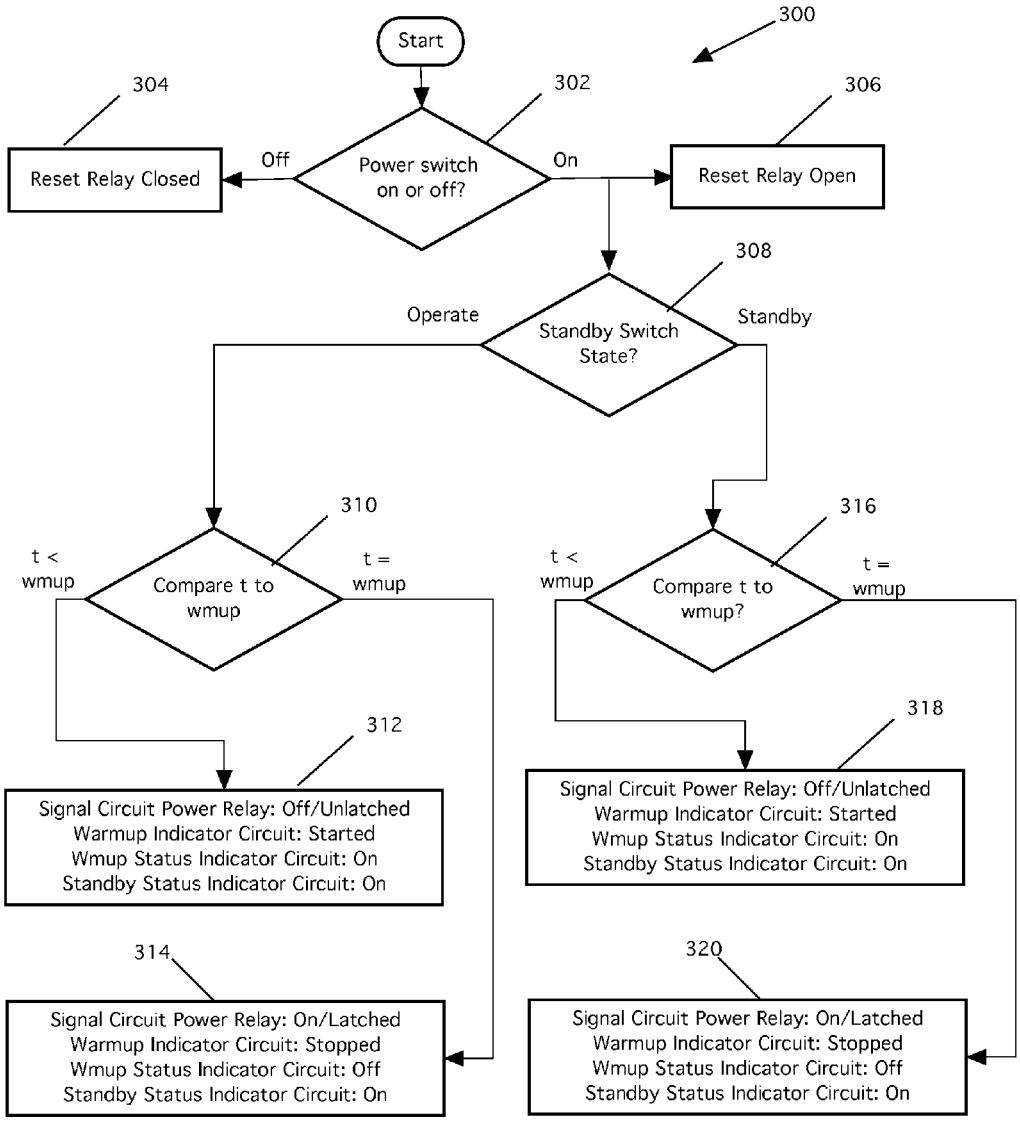
FIG. 3 is a flow chart depicting operation of the vacuum tube optimizer circuit with a vacuum tube device having a standby switch.

In the embodiments of the invention shown in FIGS. 1-3, a relay 128 is used. There are a large number of other voltage, or current, dependent switching devices which could be used to perform these functions, including triacs, silicon control rectifiers, systems of optotriggers and thyristors, optocouplers, digital controllers, transistors, transistors triggering triacs, silicon control rectifiers, and so on.

Within the embodiment of the invention shown in FIG. 1, Reset Relay 128 is powered by a low direct current voltage, rectified from the portion of device's Power Supply transformer which powers the heaters for the vacuum tubes within the device. Reset Relay 128 could also be powered by the alternating current from the device power switch, or any other available device voltage, including a separate transformer, an external power brick, a battery, etc, not switched by the subsystems of this invention.

A number of different warmup sensor types could be incorporated into this circuit, including thermocouples, thermistors, infrared sensors, sensing of changes in resistance in the cathode heater circuit, etc, which, depending on the design of the warmup sensing circuit, would potentially obviate the need, or change the specifics of the circuit connected to for the third circuit of Reset Relay 128.

A benefit of using one an actual temperature sensor, rather than a time function, representing the longest expected warmup time of any of the vacuum tubes within the device, would come if the device were rapidly switched off, then back on, before such time that the vacuum tubes were either still at their operating temperature, or were at some intermediate temperature, between room temperature and their operating temperature. In that instance, a sensing device, such as a thermocouple, thermistor, Infrared sensing device, etc, would measure the actual needed warmup time and switch the device to its operational state more-quickly.

FIG. 2 is a flow chart 200 depicting operation of the vacuum tube optimizer circuit with a vacuum tube device without a standby switch. In this example, function of the vacuum tube optimizer circuit within vacuum tube devices without a standby switch is similar to the states that occur when the standby switch is in its "operate" position, as will be described in greater detail with respect to FIG. 3.

In one example, the only user-operated driving state controlling component is the Device Power Switch 102. This is one of the two state controllers within the present disclosure. The second driving state controller is the Warmup Indicator Circuit 116. This controller drives two different logic states, indicating whether or not the vacuum tubes have reached their operating temperatures: temp (t)<warmup (wmup) or t=wmup.

At decision block 202, a power switch, such as power switch 102 described above, can be in an on state or an off state. In particular, the vacuum tube optimizer circuit can be activated by the vacuum tube device power switch.

In an embodiment of the invention, vacuum tube device power switch activates, or deactivates, the coil of the Reset Relay 128.

At block 204, when power switch is in the "off" position, Reset Relay, e.g., 128, is deactivated and Power Drain Circuits 130-132 and warmup reset circuit 134 are connected through their components to ground. The power supply networks, e.g., power supply capacitors, of the vacuum tube device are drained of voltage potential and Warmup Indicator Circuit 116 of the vacuum tube optimizer circuit is reset to zero. This state occurs without respect to the absence or presence, or, when present, state of the standby switch.

At block 206, when power switch is in the "on" position, Reset Relay 128 is activated and Power Drain Circuits 130-132 are disconnected from the device power supply capacitors. This allows them to charge, subject to other conditions of the invention. Warm Up Reset Circuit 134 is also simultaneously removed from the warmup circuit capacitor, allowing Warmup Indicator Circuit 116 to activate and begin counting up to the amount of time necessary for the vacuum tubes to reach operating temperature, defined as t=wmup. In this state, signal circuit power relay 126 drives whether or not power supply capacitors are allowed to charge.

At decision block 208, the time counted by Warm Up Indicator Circuit 116 is compared to the time value wmup, defined as the amount of time necessary to for the vacuum tubes to reach operating temperature. In another example, as described above, t can represent a temperature or a voltage indicative of a temperature. In this regard, wmup can correspondingly represent a temperature or a voltage indicative of temperature representing operating temperature of the vacuum tube, plus an optional factor for safety. In this regard, the temperature (t) measured at warm up indicator circuit 116 can be compared to the predetermined temperature (wmup). In another example, the measure voltage (t) output by a thermally-sensitive circuit element can be compared to a predetermined voltage (wmup).

At block 210, when Warmup Indicator Circuit 116 returns a value t<wmup, the Signal Circuit Power Relay 126 is off/unlatched and the power supply capacitors are disallowed to charge. In this regard, non-heater elements in vacuum tubes are switched off. Further, Warm Up Indicator Circuit 116 continues counting up to logic state t=wmup. Even further, Warmup Status Indicator 120 is on.

At block 212, when Warmup Indicator Circuit 116 returns a value where t=wmup, Signal Circuit Power Relay 126 is switched on by activating the Latching Device 124. This is activated through the Latching Trigger Circuit 122, which becomes active when variable t reaches the value of wmup. Signal Circuit Power Relay 126 has the function of switching off Warmup Indicator Circuit 116 and Warmup Status Indicator 120, while simultaneously allowing all of the elements in the vacuum tube device to become operational. In this regard, the power supply capacitors are allowed to charge and functional, non-heater elements in the vacuum tubes are allowed to operate. In this state, Warmup Indicator Circuit 116 is held at logic state t=wmup.

FIG. 3 is a flow chart 300 depicting operation of the vacuum tube optimizer circuit with a vacuum tube device having a standby switch.

In this instance, there are three Driving State Control components/subsystems within the invention: two User-operated driving state controlling components are the Device Power Switch 102 and the Standby Switch 136. These are two of the three state controllers within the invention.

The third driving state controller is the Warmup Indicator Circuit 116. This controller drives two different logic states, indicating whether or not the vacuum tubes have reached their operating temperatures: temp (t)<warmup (wmup) or t=wmup.

At decision block 302, a power switch, such as power switch 102 described above, can be in an on state or an off state. In particular, the vacuum tube optimizer circuit can be activated by the vacuum tube device power switch.

In an embodiment of the invention, vacuum tube device power switch activates, or deactivates, the coil of the Reset Relay 128.

At block 304, when power switch is in the "off" position, Reset Relay, e.g., 128, is deactivated and Power Drain Circuits 130-132 and warmup reset circuit 134 are connected through their components to ground. The power supply networks, e.g., power supply capacitors, of the vacuum tube device are drained of voltage potential and Warmup Indicator Circuit 116 of the vacuum tube optimizer circuit is reset to zero. This state occurs without respect to the absence or presence, or, when present, state of the standby switch.

At block 306, when power switch is in the "on" position, Reset Relay 128 is activated and Power Drain Circuits 130-132 are disconnected from the device power supply capacitors. This allows them to charge, subject to other conditions of the invention. Warm Up Reset Circuit 134 is also simultaneously removed from the warmup circuit capacitor, allowing Warmup Indicator Circuit 116 to activate and begin counting up to the amount of time necessary for the vacuum tubes to reach operating temperature, defined as t=wmup. In this state, signal circuit power relay 126 drives whether or not power supply capacitors are allowed to charge.

At decision block 308, the standby switch of the vacuum tube device can be in a standby or operate state.

At decision block 310, when the standby switch is set to operate, the time counted by Warm Up Indicator Circuit 116 is compared to the time value wmup, defined as the amount of time necessary to for the vacuum tubes to reach operating temperature. In another example, as described above, t can represent a temperature or a voltage indicative of a temperature. In this regard, wmup can correspondingly represent a temperature or a voltage indicative of temperature representing operating temperature of the vacuum tube, plus an optional factor for safety. In this regard, the temperature (t) measured at warm up indicator circuit 116 can be compared to the predetermined temperature (wmup). In another example, the measure voltage (t) output by a thermally-sensitive circuit element can be compared to a predetermined voltage (wmup). In this state, the vacuum tube optimizer circuit can operate as discussed below.

Warmup Indicator Circuit 116 controls the operational state of the vacuum tube device, after power switch 102 has been activated.

Cathode heater power flows to the vacuum tubes within the vacuum tube device. If their heaters are functional, their internal temperatures begin to rise.

Warmup Indicator Circuit 116 begins counting the value of the cathode temperature sensing means. As long as the voltage, resistance, or other state of the sensing means remains below the value for its output, which has been defined as "wmup," the Signal Circuit Power Relay 126 is "off". In this state, no device power can be delivered to supply power to the anodes, cathodes, and/or other thermionically-active components of the vacuum tubes, which are non-cathode heater internal components of the vacuum tube.

At block 312, when Warmup Indicator Circuit 116 returns a value less than t=wmup, Warmup Status Indicator 120 is turned on, to alert the user that the device is active and warming up. Warmup Status Indicator 120 is optional for the function of the invention, but is present as an affordance to the user, indicating that the device is functioning and is underway to reaching an operating state.

Signal Circuit Power Relay 126 is a latching triple pole single throw, normally closed relay. The latching effect in these embodiments is controlled through Warmup Circuit 116 triggering the Latching Trigger Circuit 122, which in turns triggers the Latching Device 124. When the Latching Device 124 is triggered, current is allowed to flow through the coil of Signal Circuit Power Relay 126, activating its internal switches.

In the present embodiment of the invention, the Latching Circuit 122 consists of a number of passive components and a transistor. The latching device 124 can be a Thyristor. The logic states controlling Signal Circuit Power Relay 126 are represented by the logic states:

- IF Power Switch is ON AND Standby Switch is set to OPERATE AND t=wmup then Signal Circuit Power Relay is LATCH;
- IF Power Switch is ON, AND Standby Switch is set to STANDBY AND t=wmup then Signal Circuit Power Relay is UNLATCH;
- IF Power Switch is ON AND Standby Switch is set to STANDBY AND t<wmup then Signal Circuit Power Relay is UNLATCH;
- IF Power Switch is ON AND Standby Switch B is set to OPERATE AND t<wmup then Signal Circuit Power Relay is UNLATCH; and
- IF Power Switch is OFF OR Device Power Removed, Signal Circuit Power Relay F is UNLATCH.

In the embodiment shown in FIGS. 1 and 3, when Warmup Circuit 116 returns a value less than t=wmup and the standby switch is not in the "standby" position, Standby Status Indicator 118 is not activated.

At block 314, when Warmup 116 reaches t=wmup and Standby Switch 136 is in the "operate" position, Signal Circuit Power Relay 126 latches "on." This is accomplished through triggering a thyristor, allowing the vacuum tube device circuit providing power to the anodes, cathodes, and/or other thermionically-active components of the vacuum tubes, which are non-cathode heater internal components of the vacuum tube, to be powered.

Additionally, although depicted in the drawings, an "operational" status indicator may be present on the device, as feedback to the user that the device will process signals. This may be a status light or an analog indicator, such as a dial, bar graph, graphical icon, or acoustic feedback. During the state where t<wmup and Standby Switch 136 is in the "operate" position, this indicator will remain off, or another warmup indication, such as progress within a bar graph, a changing graphical icon, or a changing tone, may be presented.

Latching Signal Circuit Power Relay 126 allows power to Warmup Indicator Circuit 116 to be shut off, along with power to the Warmup Status Indicator 120. Warmup Status Indicator 120 will turn off. The device will now become operational. In one example, latching signal circuit power relay 126 could also activate and latch power to the "operational" status indicator, thereby indicating that the vacuum tube device is operational and ready for normal use.

As discussed above, decision block 308 represents the state of the standby switch, being either in Operate or Standby. At decision block 316, when the standby switch is set to Standby, the time counted by Warm Up Indicator Circuit 116 is compared to the time value wmup, defined as the amount of time necessary to for the vacuum tubes to reach operating temperature. In another example, as described above, t can represent a temperature or a voltage indicative of a temperature. In this regard, wmup can correspondingly represent a temperature or a voltage indicative of temperature representing operating temperature of the vacuum tube, plus an optional factor for safety. In this regard, the temperature (t) measured at warm up indicator circuit 116 can be compared to the predetermined temperature (wmup). In another example, the measure voltage (t) output by a thermally-sensitive circuit element can be compared to a predetermined voltage (wmup). In this state, the vacuum tube optimizer circuit can operate as discussed below.

Warmup Indicator Circuit 116 controls the operational state of the device, after power switch A has been activated.

Cathode heater power flows to the vacuum tubes within the device. If their heaters are functional, their internal temperatures begin to rise.

Standby Switch 136 is in the "standby" position, activating Standby Status Indicator 118. The Standby Status Indicator is not necessary for the function of the invention, but it provided as an affordance to the user, indicating to them that the device is warmed up (or warming up), but is not in an active state. In this case, Standby Status is indicated by a light.

Warmup Indicator Circuit 116 begins counting the value of the cathode temperature sensing means. As long as the voltage, resistance, or other state of the sensing means remains below the value for its output, which has been defined as "wmup," and the Standby Switch remains in the "standby" position, the Signal Circuit Power Relay 126 is "off". In this state, no device power can be delivered to supply power to the anodes, cathodes, and/or other thermionically-active components of the vacuum tubes, which are non-cathode heater internal components of the vacuum tube.

When Warmup Indicator Circuit 116 returns a value less than t=wmup and Standby Switch 136 is in the "standby" position, Warmup Status Indicator 120 is not turned on.

Signal Circuit Power Relay 126 is a latching triple pole single throw, normally closed relay. The latching effect in these embodiments is controlled through Warmup Circuit 116 triggering the Latching Trigger Circuit, which in turns triggers the Latching Device 124. When the Latching Device 124 is triggered, current is allowed to flow through the coil of Signal Circuit Power Relay 126, activating its internal switches.

In the present embodiment of the invention, the Latching Circuit 122 consists of a number of passive components and a transistor. The latching device 124 itself is a Thyristor. The logic states controlling Signal Circuit Power Relay 126 are represented by the logic states:

- IF Power Switch A ON AND Standby Switch B OPERATE AND t=wmup then Signal Circuit Power Relay LATCH;
- IF Power Switch A ON, AND Standby Switch B STANDBY AND t=wmup then Signal Circuit Power Relay UNLATCH;
- IF Power Switch A ON AND Standby Switch B STANDBY AND t<wmup then Signal Circuit Power Relay UNLATCH;
- IF Power Switch A ON AND Standby Switch B OPERATE AND t<wmup then Signal Circuit Power Relay UNLATCH; and
- IF Power Switch A OFF OR Device Power Removed, Signal Circuit Power Relay F UNLATCH.

When Warmup G reaches t=wmup and Standby Switch B is in the "standby" position, Signal Circuit Power Relay F is not allowed to latch "on." In the embodiment shown in drawing 3, the standby circuit prevents the Latching Trigger Circuit and hence, the Latching Device from being powered.

The device is not allowed to become operational, until such time that Standby Switch 136 is switched to "operate" and t=wmup in Warmup Indicator Circuit 116.

In one example, it may also be desirable to turn Warmup Status Indicator 120 on, while the device is in standby mode, as an indication of the warmup status of the device, despite the fact that it will not switch into operational mode, when t=wmup.

In some examples, a user may switch the standby switch from Operate to Standby while the Power switch is on and before t=wmup, e.g., t<wmup. In this instance, the status of Warmup Indicator Circuit 116 can take precedence.

Standby Status Indicator 118 can shut off and Warmup Status Indicator 120 can be activated to alert the user that the device is active and warming up. The components of the vacuum tube optimizer circuit would begin operation at whatever state was represented by the value of the variable t. Warmup Status Indicator 120 is optional, but is present as an affordance to the user, indicating that the device is functioning and is underway to reaching an operating state.

If t<wmup and Standby Switch=operate, Signal Circuit Power Relay 126 remains off and unlatched. Additionally, Warmup Status Indicator 120 remains "on." Further, Standby Status Indicator 118 switches "off." Finally, if present, the "operational" status indicator remains "off."

In another embodiment of the invention, Warmup Status Indicator 120 would also be active simultaneously with Standby Status Indicator J.

In some examples, the vacuum tube can lower power, such as by way of main power interruption, circuit breaker, or fuse interruption, accidentally unplugging, loss of battery power, or other unplanned incident causing device shutoff. In this regard, it is assumed that power switch is in the "on" position at the moment of interruption.

In this example, in the instance of loss of device power, the vacuum tube optimization circuit would function as if the power switch were to be switched to the "off" position, such as in blocks 204 and 304 above. Since the tube device would no longer be powered, the vacuum tube optimization circuit would also lose power.

In addition, Signal Circuit Power Relay 126 would unlatch, disconnecting the device power supply capacitors from the anodes, cathodes, and/or other thermionically-active components of the vacuum tubes, which are non-cathode heater internal components of the vacuum tube.

Reset Relay 128 would lose power, causing its internal switches to close. The result of this would be that Power Supply Drain Circuits 130-132 would be connected between the device power supply capacitors and ground, draining any stored charge from the device power supply.

Warmup Reset Circuit 134 would connect between the timer capacitor in Warmup Circuit 116 and ground, and in the case of the present embodiment of the device, wherein time (t) is being used to indicate warmup status, draining the timer capacitor of charge and resetting t to zero.

In the event that main power were then resumed, while Power Switch was still in the "on" position, the conditions would resume as set forth in FIGS. 2 and 3 with Power Switch 102 in the "on" position.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. Accordingly, this description is meant to be taken only by way of example, and not to otherwise limit the scope of this invention.

What is claimed is:

1. A vacuum tube optimization circuit, comprising:

a warmup indicator circuit configured to compare a first measured warmup variable to a predetermined warmup variable for a vacuum tube;

a signal circuit power relay configured to allow for power to be provided to the vacuum tube when the first measured warmup variable is equal to the predetermined warmup variable for the vacuum tube;

a latching device connected to the signal power circuit relay; and a latching trigger circuit connected to the latching device and to the warmup indicator circuit.

2. The circuit of claim 1, wherein the first measured warmup variable is a warmup time and the predetermined warmup variable represents a warmup time associated with warming the vacuum tube up to operating temperature.

3. The circuit of claim 1, wherein the first measured warmup variable is a temperature and the predetermined warmup variable represents a warmup temperature associated with the operating temperature of the vacuum tube.

4. The circuit of claim 1, wherein the first measured warmup variable is a voltage output from a thermally sensitive circuit element and the predetermined warmup variable represents a warmup output voltage of a thermally sensitive circuit element when the vacuum tube has reached operating temperature.

5. The circuit of claim 1, further comprising:

a warmup status indicator that indicates a status of the vacuum tube with respect to the predetermined warm up variable.

6. The circuit of claim 1, further comprising:

a reset relay circuit connected to one or more power drain circuit and a warmup reset circuit.

7. The circuit of claim 2, wherein the predetermined warmup time is a longest warmup time associated with one of a plurality of vacuum tubes.

8. A vacuum tube device, comprising:

a vacuum tube;

a power supply for supplying power to the vacuum tube;

a vacuum tube optimization circuit, comprising:

a warmup indicator circuit configured to compare a first measured warmup variable to a predetermined warmup variable for a vacuum tube;

a signal circuit power relay configured to allow for power to be provided to the vacuum tube when the first measured warmup variable is equal to the predetermined warmup variable for the vacuum tube;

a latching device connected to the signal power circuit relay; and a latching trigger circuit connected to the latching device and to the warmup indicator circuit.

9. The vacuum tube device of claim 8, further comprising:

a power switch; and a standby switch.

10. The vacuum tube device of claim 8, wherein the first measured warmup variable is a warmup time and the predetermined warmup variable represents a warmup time associated with warming the vacuum tube up to operating temperature.

11. The vacuum tube device of claim 8, wherein the first measured warmup variable is a temperature and the predetermined warmup variable represents a warmup temperature associated with the operating temperature of the vacuum tube.

12. The vacuum tube device of claim 8, wherein the first measured warmup variable is a voltage output from a thermally sensitive circuit element and the predetermined warmup variable represents a warmup output voltage of a thermally sensitive circuit element when the vacuum tube has reached operating temperature.

13. The vacuum tube device of claim 8, wherein the vacuum tube optimization circuit further comprises:

a warmup status indicator that indicates a status of the vacuum tube with respect to the predetermined warm up time.

14. The vacuum tube device of claim 8, wherein the vacuum tube optimization circuit further comprises:

a reset relay circuit connected to one or more power drain circuit and a warmup reset circuit.

15. The vacuum tube device of claim 9, wherein the predetermined warmup time is a longest warmup time associated with one of a plurality of vacuum tubes.

16. A method of operating a vacuum tube optimization circuit, comprising:

(i) providing power to a vacuum tube device, the vacuum tube device including at least one vacuum tube;

(ii) determining a warm up time for the vacuum tube, the warm up time comprising a time corresponding to a fully operational state of the vacuum after the power is provided to the vacuum tube;

(iii) determining an amount of time since power was provided to the vacuum tube;

(iv) comparing the determined amount of time at step (iii) to the warm up time of step (ii); and if the determined amount of time at step (iii) is equal to the warm up time of step (ii), then commencing full operation of the vacuum tube device by triggering a latching trigger circuit connected to a latching device connected to a power circuit relay on the vacuum tube device.

* * * * *